US009396925B1

(12) United States Patent
Rice et al.

(10) Patent No.: US 9,396,925 B1
(45) Date of Patent: Jul. 19, 2016

(54) PARTIALLY COATED VEHICLE LAMP CAPSULE

(71) Applicants: Lawrence M. Rice, Hillsboro, NH (US); Robin A. Sweet, Hillsboro, NH (US); Richard Holland, Stoddard, NH (US)

(72) Inventors: Lawrence M. Rice, Hillsboro, NH (US); Robin A. Sweet, Hillsboro, NH (US); Richard Holland, Stoddard, NH (US)

(73) Assignee: OSRAM SYLVANIA Inc., Wilmington, DE (US)

( * ) Notice: Subject to any disclaimer, the term of this patent is extended or adjusted under 35 U.S.C. 154(b) by 37 days.

(21) Appl. No.: 14/633,390

(22) Filed: Feb. 27, 2015

(51) Int. Cl.

| | |
|---|---|
| ***H01K 1/26*** | (2006.01) |
| ***H01J 61/40*** | (2006.01) |
| ***H01K 1/32*** | (2006.01) |
| ***H01K 1/40*** | (2006.01) |

(52) U.S. Cl.
CPC ... *H01K 1/32* (2013.01); *H01K 1/40* (2013.01)

(58) Field of Classification Search
CPC ..... H01K 1/32; H01K 1/40
USPC ..... 313/110–112
See application file for complete search history.

(56) References Cited

U.S. PATENT DOCUMENTS

| | | | |
|---|---|---|---|
| 5,017,825 | A | 5/1991 | Heijnen et al. |
| 5,111,105 | A | 5/1992 | Yamamoto |
| 5,660,462 | A | 8/1997 | Bockley et al. |
| 6,093,999 | A | 7/2000 | English et al. |
| 6,281,630 | B1 | 8/2001 | English et al. |
| 6,342,762 | B1 | 1/2002 | Young et al. |
| 6,369,510 | B1 | 4/2002 | Shaw et al. |
| 6,508,573 | B1 | 1/2003 | Yamazaki |
| 6,670,768 | B1 | 12/2003 | Labant |
| 6,731,051 | B2 | 5/2004 | Oetken et al. |
| 7,178,957 | B2 | 2/2007 | Schug et al. |
| 7,362,049 | B2 | 4/2008 | Raukas et al. |
| 7,670,037 | B2 | 3/2010 | Devir et al. |

FOREIGN PATENT DOCUMENTS

WO 2008074657 A2 6/2008

OTHER PUBLICATIONS

Osram "Night Breaker" lamp marketed by Osram Sylvania Inc., on sale prior to present application filing date, product information appearing at website www.osram.com (1 page, in color), Aug. 19, 2014.

Derlofske et al., "Visual Benefits of Blue Coated Lamps for Automotive Forward Lighting" (Society of Auto. Engineers 2003-01-0930) (8 pgs.).

Sivak et al., "LED Headlamps: glare and color rendering", Lighting Res. The. 36,4 (2004) at pp. 295-305.

*Primary Examiner* — Joseph L Williams
(74) *Attorney, Agent, or Firm* — Edward S. Podszus

(57) ABSTRACT

An automotive lamp capsule (12) containing filament (24) mounted within a capsule envelope (20) that has a light-transmissive coating (60) that increases the color temperature of light passing therethrough. Two uncoated windows (62) on envelope (20) in register with filament (24) extend towards capsule base (20) and alternate, in a direction circumferentially around capsule envelope (20), with two coated portions (64) at that axial location along optical axis (O). A distance from filament (24) to a lower edge (68) of window (62) bounds a region of light emitted from filament (24) whose color temperature is not increased by coating (60) and defines the hot spot (105) in a beam projected from a vehicle reflector (14) in which capsule (12) is mounted. Light emitted by filament (24) passing adjacent to windows (62) through regions of coating (60) form a spread light pattern (112) of advantageous, higher color temperature than previously achievable.

17 Claims, 10 Drawing Sheets

PARTIALLY COATED VEHICLE LAMP CAPSULE

CROSS REFERENCE TO RELATED APPLICATIONS

N/A

TECHNICAL FIELD

The present disclosure relates to electric lamps and particularly to automotive lamp capsules that have a partial coating that in selective regions shifts the light output to a higher color temperature. More particularly, it relates to such lamp capsules having a blue tinted absorption coating.

BACKGROUND AND ACKNOWLEDGED PRIOR ART

Tungsten halogen automotive lamps having a bluish coating to shift the color temperature of the light produced to a whiter, higher color temperature are known, such as in U.S. Pat. No. 6,369,510 (Shaw). A commercial embodiment of a lamp depicted in the Shaw Pat. '510 is sold in the United States by Osram Sylvania Inc. (OSI) under the trade designation "Silverstar" in which the capsule's entire light-emitting region (disregarding the upper dome, which is opaque, for glare control) has a bluish coating. The bluish coating is an absorption coating on the glass outer envelope that absorbs light at a peak of around 600 nm (the yellow-red region), and although the transmission of the bulb still results in a continuous output spectrum, it has a lower "yellow" content than uncoated halogen sources, see FIG. 6 of Shaw Pat. '510. Because the entire capsule is coated, the entire beam distribution has a color temperature of about 3800° K (in comparison, an uncoated, standard 9006-type halogen capsule produces that beam distribution with a lower color temperature of about 3050° K).

A whiter beam color is perceived stylistically as aesthetically pleasing and can approximate the appearance of more expensive HID (High Intensity Discharge) lamps. The higher color temperature beam has the functional advantage of improved color contrast to aid obstacle detection and road surface orientation. The higher color temperature beam has the further functional advantage of higher effective intensity in peripheral vision, where the retina of the eye has proportionately more photoreceptors of the type that are rods than the type that are cones. Rods are more sensitive to blue light than the cones which are in the retina's central fovea region and are predominantly found in central vision, as discussed in Derlofske et al., "Visual Benefits of Blue Coated Lamps for Automotive Forward Lighting" (Society of Auto. Engineers 2003-01-0930). Higher color temperature light could, in theory, have an advantage in maintaining operator alertness at night. However, there is a tradeoff in that it is understood that while whiter light does not cause an increase in disability glare, there is an increase in perceived discomfort glare, as discussed in Sivak et al., "LED Headlamps: glare and color rendering", Lighting Res. The. 36,4 (2004) at pp. 295-305.

Also known is PCT WO 2008/074657 (Leunnemann). A tinted vehicle lamp similar to that depicted in FIG. 2 of the PCT WO 2008/074657 has been marketed by Osram Sylvania Inc. in the United States under the trade designation "Night Breaker". This lamp also uses a coating of the type in Shaw Pat. '510 which absorbs more yellow, red and green wavelength light than it does blue and violet light. The "Night Breaker" lamp is shown herein at FIGS. 1 and 2. The uncoated part of the lamp illuminates the hot spot part of the optics in the headlight, producing yellower light for the hot spot without intensity loss from having passed through the coating. A portion of the spread optics is illuminated by light which has first passed through the blue coated part of the lamp. However, there is still a large proportion of spread optics beam which receives light which does not pass through the blue coating.

As shown in FIG. 1, the "Night Breaker" lamp capsule with axial filament has a non-light transmissive dome 50, for example black paint, at its top and the two coated bluish regions are indicated in cross-hatching. There is an uninterrupted, uncoated band-like region that separates the two coated regions, the uncoated region extending around the entire capsule. The capsule diameter is 12.06 mm, and the uncoated circumferential band is 5.5 mm+/−1 as measured along the axial direction. The uncoated band, of nominal height 5.5 mm, is centered on the light center length (LCL) of the filament. A coating can be provided on the press seal 40 for manufacturing convenience but that is not optically relevant since the press seal becomes held inside the base connector coupling it to the reflector. As shown in FIG. 2, the spacing of the upper edge of the lower region of coating from the filament is such that light emitted from the capsule in a direction toward the capsule base passes through the uncoated widow along a conical envelope directed toward the capsule base and subtended by an angle, referred to as an extent angle, of about 130 to 137 degrees centered on the filament. Similarly, light extends along a similar conical envelope directed forward (direction of dome 50), but that is not light that is managed by the reflector.

The following lamps are also known: U.S. Pat. No. 6,093,999 (English); U.S. Pat. No. 6,281,630 (English); U.S. Pat. No. 6,342,762 (Young); U.S. Pat. No. 7,362,049 (Raukas); U.S. Pat. No. 6,731,051 (Oetken); U.S. Pat. No. 6,670,768 (Labant); U.S. Pat. No. 7,670,037 (Devir); U.S. Pat. No. 6,60,462 (Bockley); U.S. Pat. No. 7,178,957 (Schug); U.S. Pat. No. 5,017,825 (Heijnen); and U.S. Pat. No. 6,508,573 (Yamazaki).

BRIEF DESCRIPTION OF THE DRAWINGS

Reference should be made to the following detailed description, read in conjunction with the following figures, wherein like numerals represent like parts.

For a thorough understanding of the present disclosure, reference is made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION INCLUDING BEST MODE OF A PREFERRED EMBODIMENT

Figure 1:
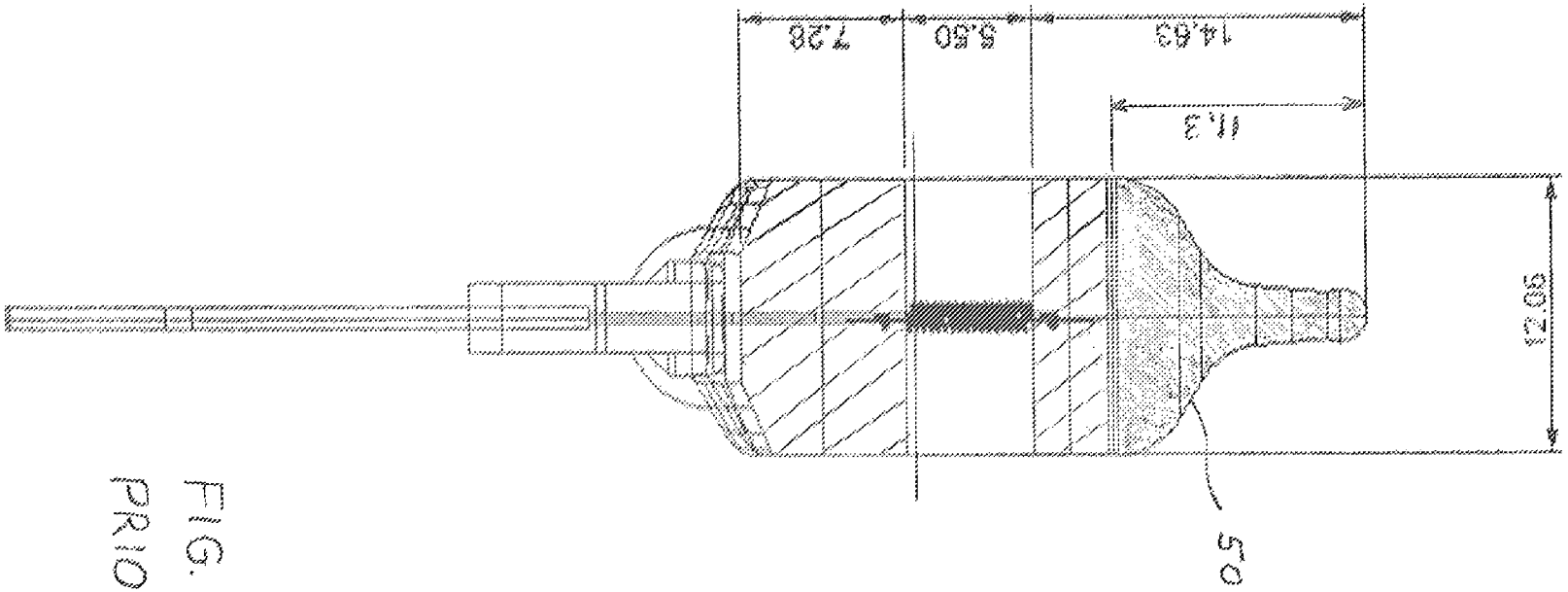
FIG. 1 PRIOR ART
FIG. 1 is a view of a prior art "Night Breaker" capsule with uncoated band.
Figure 2:
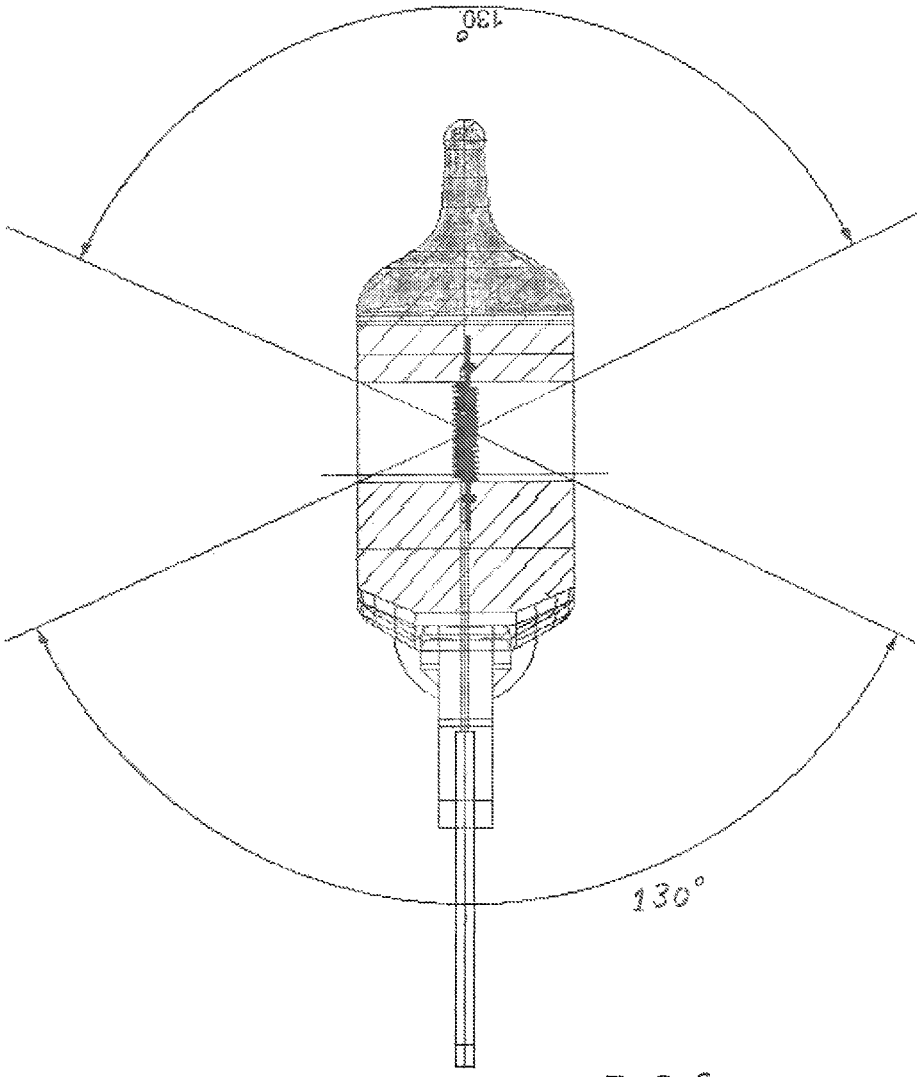
FIG. 2 PRIOR ART
FIG. 2 is another view according to FIG. 1.
Figure 3:
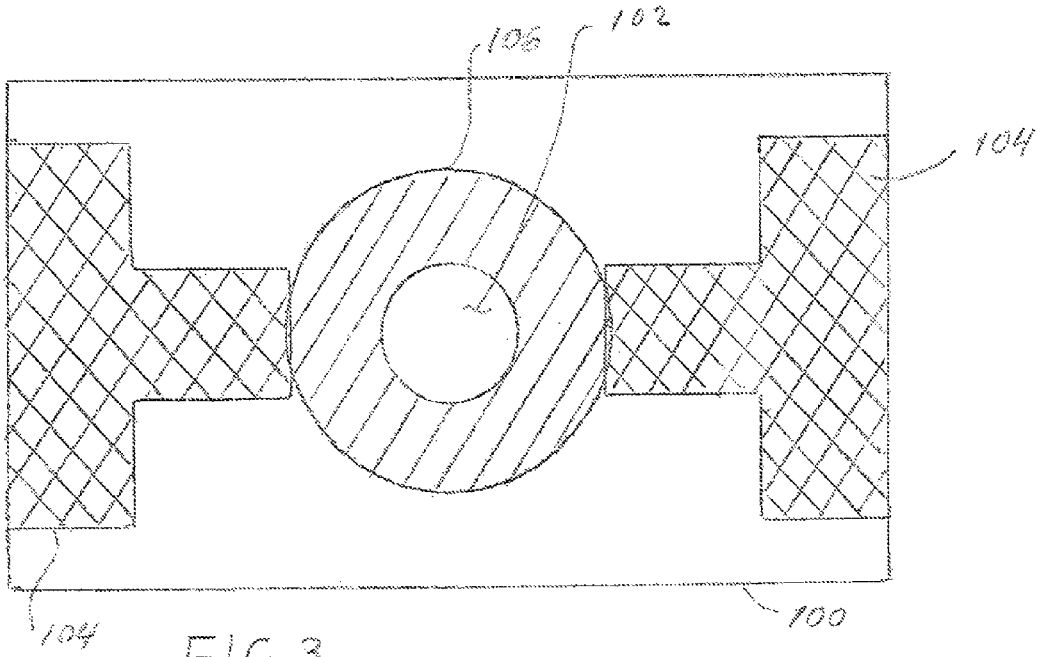
FIG. 3 is a simulated reflector extent diagram using a capsule of FIG. 1.

FIG. 3 is a simulation model, generated by the present Applicants, based on the known "Night Breaker" lamp capsule of FIGS. 1-2 as seen in a front view of the reflector extent 100, that is, as if one were standing in front of a vehicle and looking into an axially-oriented filament coil headlamp from the front. The lamp capsule is mounted inside socket hole 102. Light is reflected off reflector extent 100. The regions that form the hot spot are shown in the double-cross hatched split dumbbell shaped area 104. The hot spot images are located to the sides of the lamp spaced out from socket hole 102, and just above and below the horizontal centerline of the lamp at the ends of the horizontal extent, in a kind of dumbbell shape with a hole in the center. The area outside of the split dumbbell is the region of the reflector extent that contributes to the spread light. Only the area inside of the single-hatched ring 106 is the portion of reflector extent 100 that is illuminated by the bluer light passing through the blue coating on the "Night Breaker" lamp. Applicants herein appreciated that as shown in FIG. 3, the spread light region, i.e. the region of reflected images on reflector extent 100 outside of the dumbbell-shaped hot spot 104, is only somewhat bluish. This is evident from FIG. 3 because the light that aggregates to form the spread light comes only partly through the coated region and much of the spread light area is illuminated by light coming through the uncoated band of the "Night Breaker" lamp which produces yellower light. Applicants herein observed that the images from reflector extent 100 above and below socket hole 102 contribute strongly to the spread light; put in other words, there is an area around socket hole 102 that cannot contribute to the hot spot, owing to the filament location. Rather, the region around socket hole 102 strongly contributes to the spread light as this portion of the reflector receives light from the region back from the filament to socket hole 102.

Figure 4:
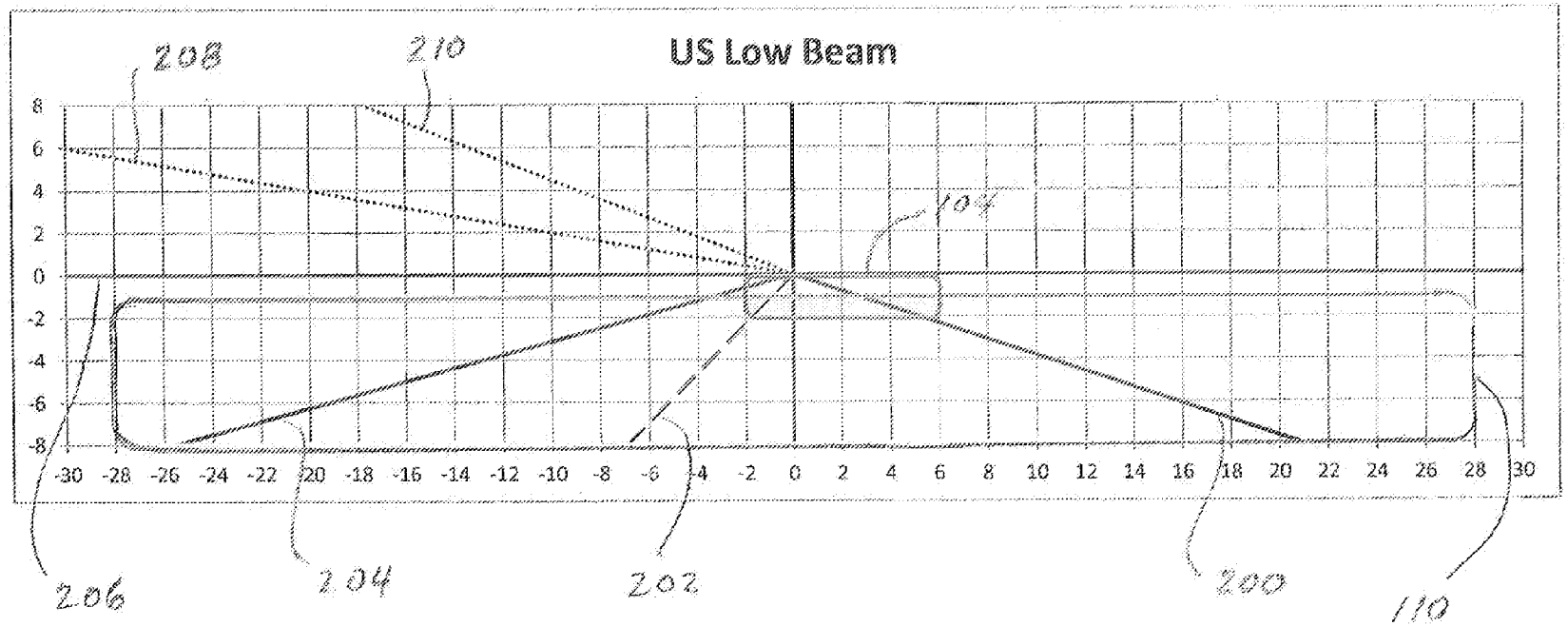
FIG. 4 is a simulated low beam pattern produced using a capsule of FIG. 1.

FIG. 4 is a simulation, generated by the present Applicants, of the beam pattern generated onto the road by the known "Night Breaker" lamp capsule of FIGS. 1-2 showing hot spot 104 and spread light 110. As used in FIG. 4 and FIG. 11, the reference lines on a standard beam distribution reference frame are as follows: road right edge 200; road center line 202; road left edge 204; horizon line 206; on-coming driver's eye position in a car of standard height 208; and on-coming driver's eye position in a truck or SUV of taller height 210. Hot spot 104 has a color temperature of about 3050° K, spread light pattern 110 has a color temperature of about 3800° K, and there is an overlap area that has color temperature in-between those. The spread light region 110 has a color temperature resulting from contributions of light passing through both blue-coated as well as uncoated glass regions.

The present Applicants determined that given considerations of increased glare perception of whiter light and the relative lack of advantage for whiter light in central vision, an improved light source would provide whiter light in the parts of the headlight beam which are spread out to the sides, in which the driver's peripheral vision plays a more primary role (spread light), and would provide yellower light in the high intensity area of the beam that primarily involves the driver's central vision and is the main source of glare for other road users such as oncoming drivers (hot spot).

An exemplary vehicle headlamp of the present embodiment is shown in FIGS. 5, 6, 7, 8 and 9. A vehicle headlamp 10 includes a lamp capsule 12 mounted within a reflector 14. A lamp base 16 receives capsule 12 and mechanically mounts lamp capsule 12 in reflector 14 and supplies electrical energy to capsule 12, as is known for example in U.S. Pat. No. 6,281,630 (English et al.) which discusses details of capsule construction and is incorporated by reference as if fully set forth herein. In a known manner the open side of reflector 14 is closed by a light-transmissive cover or lens (not shown).

Lamp capsule 12 includes a lamp envelope 20 of a light-transmissive material, such as glass, which defines an enclosed volume 22. Lamp envelope 20 includes a generally tubular portion 42 having a generally central axis defining an optical axis O. Tubular portion 42 is closed at its upper region 25 by a tip-off portion, or dome, 50 and closed at the lower capsule base 26 by press seal 40. A filament 24, such as for a low beam light source, is mounted within lamp envelope 20. Typically filament 24 for a low beam is located on or near the central optical axis O of lamp capsule 12. Filament 24 has an axial extent along optical axis O. First and second external electrical leads 34, 36 extend through press seal 40 and make electrical contact, within press seal 40, to internal filament supports 30, 32 which provide mechanical support to and electrical connection to filament 24. Lamp capsule 12 can optionally have a second, high beam filament (not shown), as is known for example in U.S. Pat. No. 6,281,630, or auxiliary filament sources such as a side or turning beam as is known in U.S. Pat. No. 7,670,037 (Devir), each of which are incorporated by reference as if fully set forth herein.

The lamp vessel or capsule has at its free distal end a dome 50 having a non-transparent coating 52. The dome coating 52 is a light-attenuating layer, such as black paint, that covers the outside surface of dome 50 and is opaque. The opaque cap or coating 52 prevents or substantially prevents the transmission of light through dome 50. For example, opaque coating 52 blocks at least 95% of incident light. The opaque coating 52 can optionally be colored, for example, gold, silver or blue.

In an alternative embodiment (not shown) filament 24 can be arranged for the so-called transverse coil headlamp, in which case filament 24 has a length dimension defined between its filament end portions, the length dimension being its major dimension. In that case the filament length extends perpendicular optical axis O.

Reflector 14 has a reflecting surface 80 that typically has one or more sections, each, for example, being a parabolic surface of revolution about an optical axis of the reflector. Lamp capsule 12 is positioned by base 16 such that filament 24 (and optional high beam filament) are located at or near the focal points of the reflecting surface, and central optical axis O of lamp capsule 12 is co-linear with the optical axis of reflector 14. Light emitted, for example, by filament 24 is reflected by reflecting surface 80 in a forward direction through an open side of reflector 14, and directed nearly parallel to the optical axis of reflector 14 and produces a desired beam pattern, for example a low beam pattern. Similarly, light emitted by a second, high beam filament is reflected by reflecting surface 80 in a forward directed and produces a second desired beam pattern, such as a high beam pattern. Reflecting surface 80 may have different parabolic sections and may be complex. The reflecting surface may include more than one parabolic reflector. Embodiments of lamp capsule 12 are useable with a variety of different reflector configurations, the reflector being generally permanently mounted on the vehicle and the lamp capsule 12 being available as a replacement part to be received in various different vehicle models when a previous lamp burns out and needs to be exchanged.

A second, high beam filament could be present as is known in FIG. 2 of U.S. Pat. No. 6,281,630 (English), incorporated herein by reference. It is understood the filament 24 and, if present, a second high beam filament are spaced apart within lamp envelope 20 and have different positions relative to the focal point of reflecting surface 80, thus producing different beam patterns. Typically a second filament for high beam would be spaced from filament 24, its length similarly being oriented in an axial direction as the depicted filament 24, but displaced axially towards press seal 40 relative to filament 24, as is generally shown in FIG. 2 of U.S. Pat. No. 6,281,630 (English).

Figure 5:
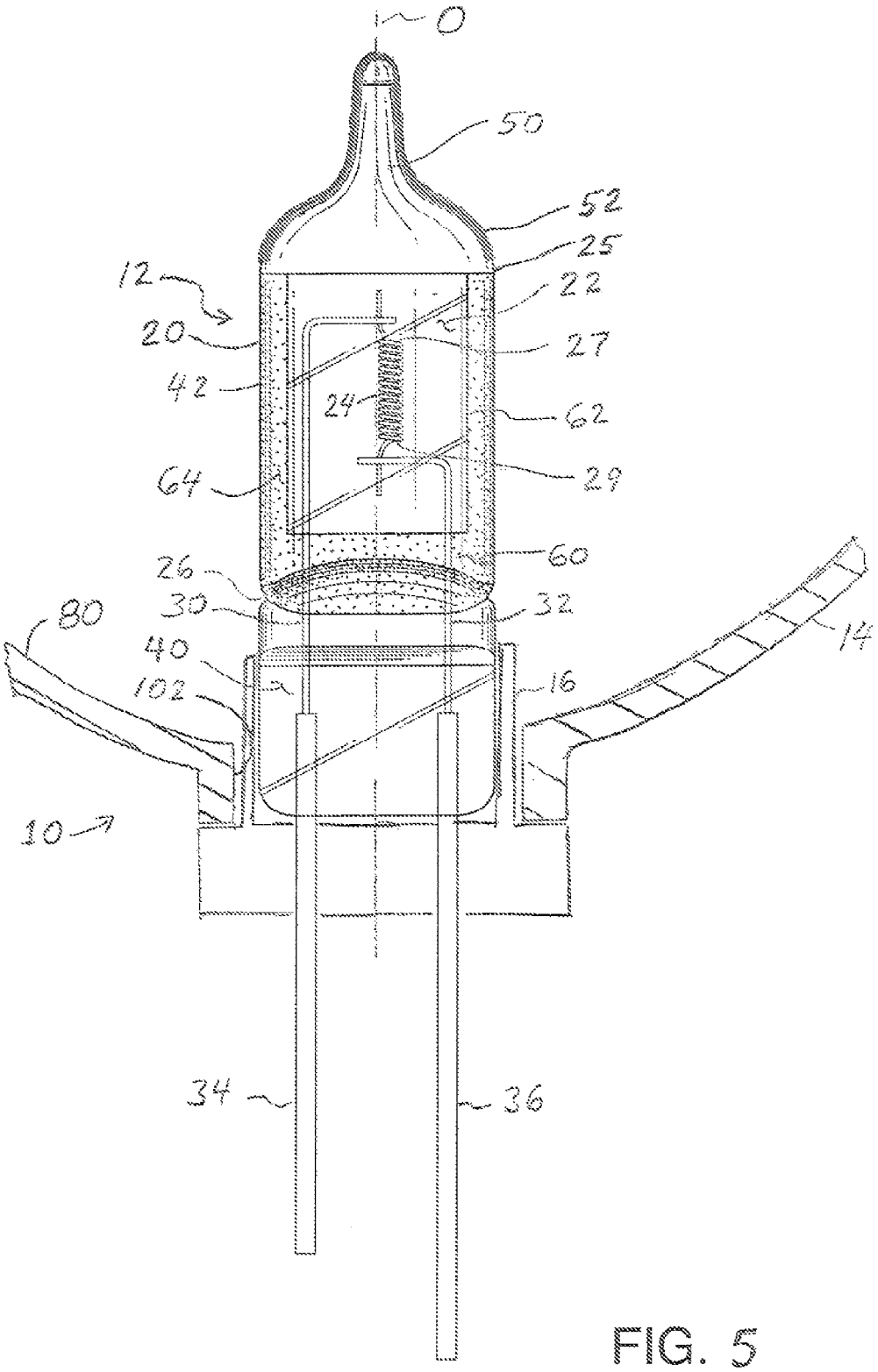
FIG. 5 depicts lamp capsule 12 of the present embodiment.

As shown in FIG. 5, filament 24 is arranged as a so-called axial coil headlight. The filament 24 has a filament distal portion 27 proximate to capsule upper region 25 and a filament proximal portion 29 located proximate to capsule base 26 and press seal 40. For the depicted FIG. 5 orientation of a filament length axially aligned with optical axis O, the filament's terminal ends define distal and proximal portions 27, 29, respectively.

Capsule 12 along its envelope 20 has a filter applied thereto in selective regions that alters the color temperature of the light issuing from capsule 12. An exemplary filter is a coating 60 applied to envelope 20. Suitable as coating 60 is the bluish absorption coating disclosed in U.S. Pat. No. 6,369,510 (Shaw). The bluish coating 60 is an absorption coating on the glass outer envelope that absorbs light at a peak of around 600 nm (the yellow-red region), and although the transmission of the bulb still results in a continuous output spectrum, it has a lower "yellow" content than uncoated halogen sources, see FIG. 6 of Shaw '510 Pat. Coating 60 thus absorbs more yellow, red and green wavelength light than it does blue and violet light. This results in the white light from a light source, such as filament 24, that passes through coating 60 being shifted to a higher color temperature and to appear more bluish. Lamp capsule 12 can be dip-coated as is known in Shaw Pat. '510, and then regions on lamp enveloper 20 that have been coated but are to be uncoated in the finished capsule 12 have coating 60 removed locally by trimming in a defined manner by a laser, in a process known in the art. The amount of absorption achieved by coating 60 and the color temperature of the light passed therethrough can be controlled by the coating thickness as taught in Shaw Pat '510. If expedient, the region of capsule 12 at upper region 25 at dome 50 can be coated and, if opaque layer 52 is applied, opaque layer 52 can be applied over coating 60. If desired, press seal 40 can also be coated, as indicated in FIG. 6.

Figure 6:
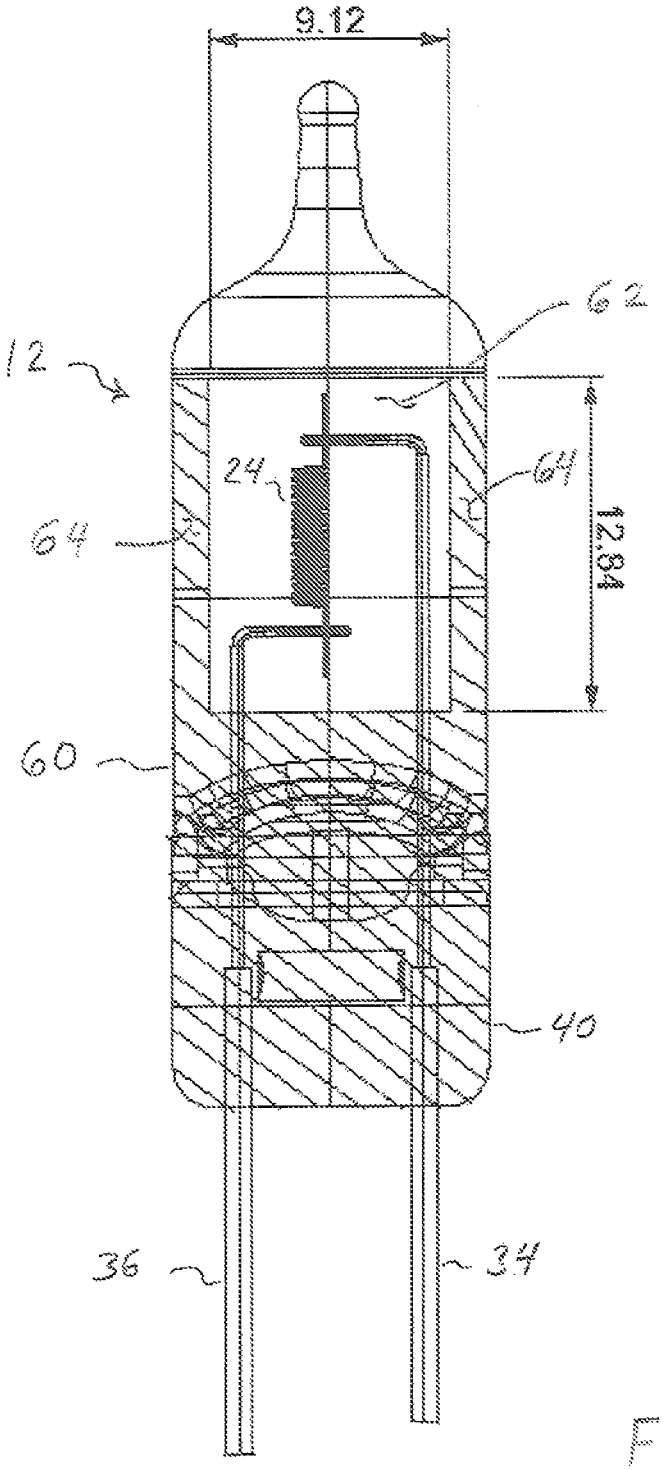
FIG. 6 depicts the lamp of FIG. 5 with representative dimensions.
Figure 7:
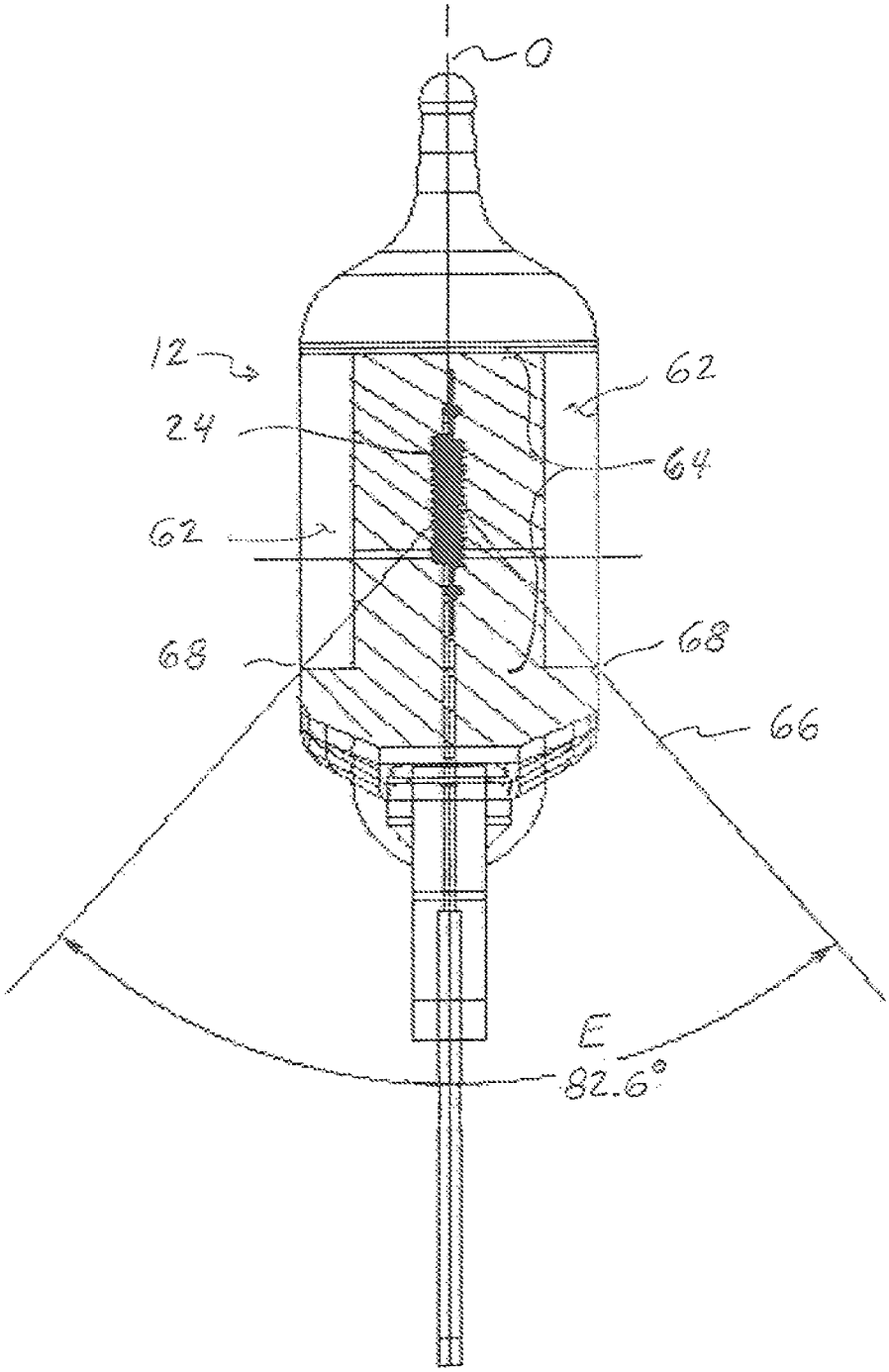
FIG. 7 is a side view of the lamp of FIG. 5.

FIGS. 6 and 7 show that coating 60 is not present on two windows 62, which are devoid of the coating, and can be referred to as clear. Preferably windows 62 are regions where light from filament 24 generally just passes through the material of which envelope 20 is formed. The size and positioning of windows 62 is such that the light from filament 24 that passes through them is the light that will strike the portions of reflector 14 that are used for long range light, the so-called hot spot. In axial direction, each clear window 62 is at least as long as filament 24, and filament 24 is in register with and surrounded by window 62. Theoretically, to be perfect, axial extent of window 62 would vary with reflector length and width, but that is not practical since a manufacturer desires to offer only a limited number of types of lamps or perhaps only one standardized replacement lamp for the aftermarket. Thus, as an engineering compromise a reasonable axial extent is chosen for the average size reflector. Since every headlight type built has a different aspect ratio and some are symmetric in the front view, placement of blue coating 60 is of necessity a compromise. As shown in FIG. 6, the capsule outer diameter over envelope 20 is 12.06 mm. Each window 62 has an axial length, in a direction along optical axis O, of 12.84 mm, and a width, seen in elevational view perpendicular to optical axis O, of 9.12 mm. In some embodiments for the same size 12.06 mm diameter capsule 12, the height of window 62 is 9.2 mm and the axial length 13.5 mm. The 9.12 mm width dimension of window 62 can be referred to as a window height since in use placed within reflector 14 it becomes oriented above and below a horizontal plane. The 9.1 mm dimension of the height of the opening or window 62 would vary with diameter of capsule envelope 20, getting smaller with smaller glass diameter of capsule envelope 20 and getting larger with larger glass diameter of capsule envelope 20; again, size of reflector 14 would ideally have an effect on designing a custom lamp capsule for each automaker's vehicle model, but practical considerations of efficiently supplying the aftermarket favor making a reasonable compromise.

As shown in FIG. 7, windows 62 have their dimensions, in particular axial length dimension along optical axis O, and position relative filament 24 chosen to generate extent angle E of about 82°, or 82.6°, for the cutoff for light between clear (uncoated)/coated regions. It is noted that window 62 extends considerably further toward capsule base 26 than does the uncoated 5.5 mm long band on the known "Night Breaker" lamp (contrast FIGS. 1-2), proximity of limit edge 68 to capsule base 26 resulting in extent angle E of about 82° being far narrower than the 130° (typ.) conical region on FIG. 2. A segment of a conical envelope 66 defines a boundary for light emitted through uncoated window 62, up to a limit edge 68 where window 62 is bounded by more regions with coating 60 proximal to capsule base 26. Envelope 66 is bounded by extent angle E and directed with its opening toward capsule base 26 and reflector 14. Specific dimensions of capsule portions covered with coating 60, or conversely size of windows 62, vary with lamp type and light center length as understood in the art.

Figure 8:
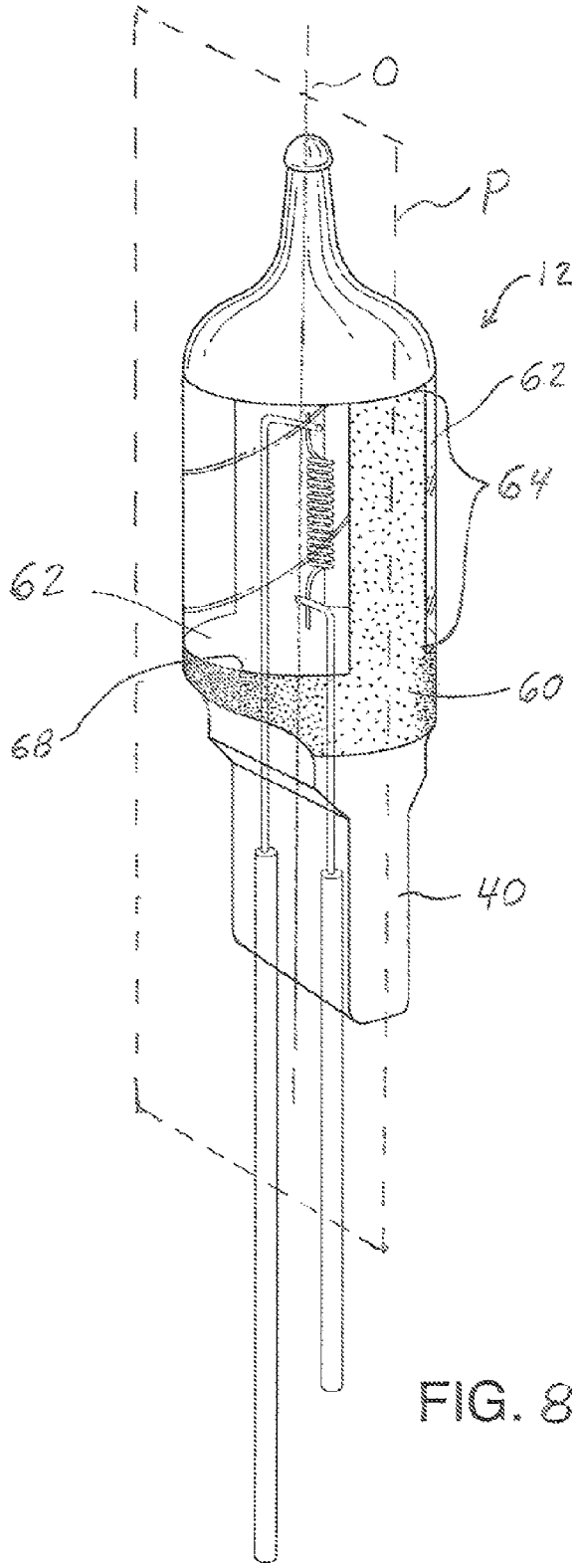
FIG. 8 is a perspective view of the FIG. 5 lamp showing dividing plane P.

As shown in FIG. 8, windows 62 are on opposite sides of an imaginary plane P that intersects optical axis O. Optical axis O also lies in plane P. Windows 62 are advantageously symmetric on opposite sides of plane P. Imaginary plane P is advantageously a plane of symmetry of filament 24 in side view and the glass portions of the lamp such as coated envelope 20, disregarding the electrical filament supports 30, 32.

As shown in FIGS. 5, 6, 7 and 8, as one traverses around the circumference of capsule envelope 20, that is, in an angular direction around optical axis O, it is noted that each uncoated opening or window 62 is bounded by a respective coated portion 64 of coating 60. The two coated portions 64 are advantageously arranged symmetric about capsule envelope 20. Coated portions 64 bound the angular extent of windows 62 and are preferably evenly coated with coating 60 in a like manner to portions of capsule envelope 20 that are below limit edge 68 near capsule base 26.

Figure 9:
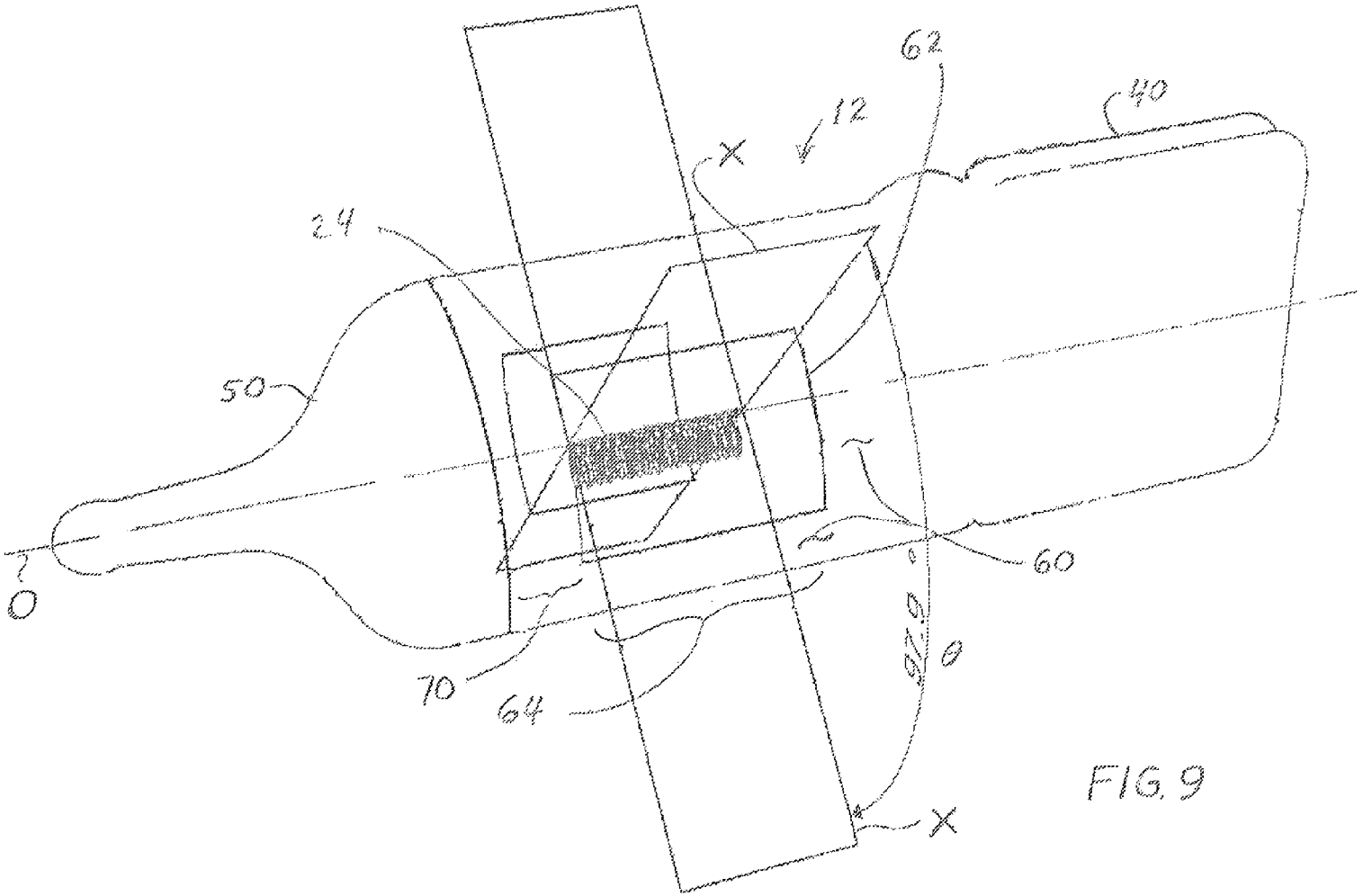
FIG. 9 schematically depicts the FIG. 5 lamp showing planes X-X.

Still further, as shown in FIG. 9, an angular extent of windows 62, given the presence of coated portions 64 to the side of and between windows 62, is defined by two intersecting imaginary planes X, X centered on filament 24 that intersect at a mutual angle θ (theta) in the range of about 87° to about 100', for example at about 97.9°.

As shown in FIG. 5, a capsule of the 9006 type, which is known in the art, has the upper end of window 62 (the portion away from capsule base 26) touching opaque cap 52. On other lamp types, as shown schematically in FIG. 9, such as those of the H4 type, it might be desirable to have a blue ring 70 of coating 60 at the capsule upper region 25, positioned above windows 62. This ring 70 can extend towards dome 50 or opaque cap coating 52 at the capsule tip.

Figure 10:
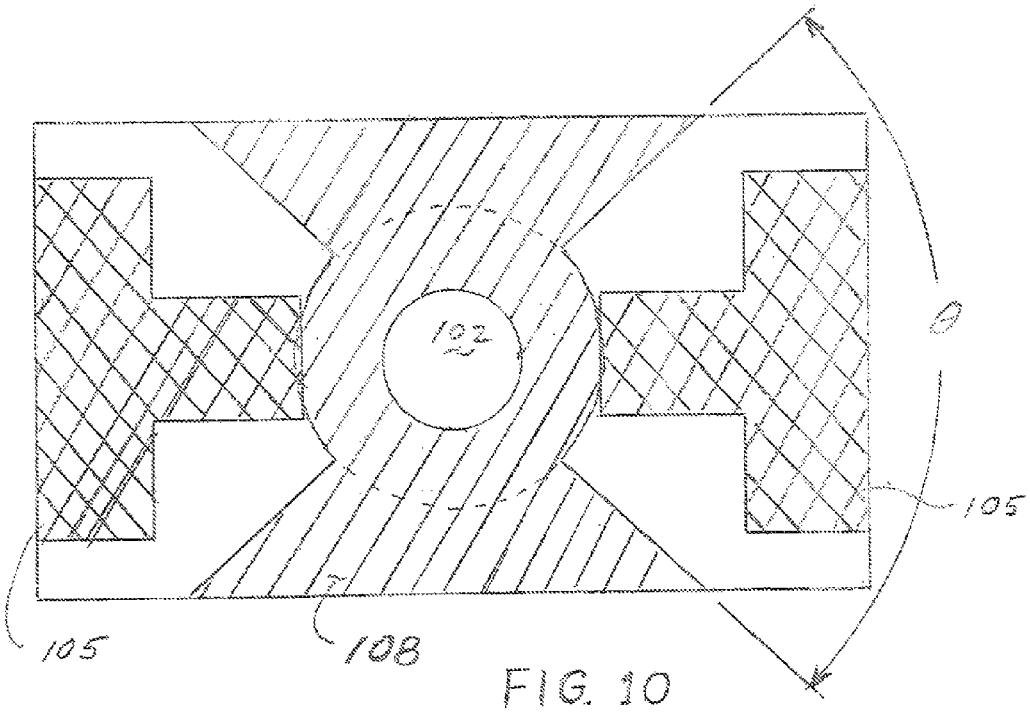
FIG. 10 is a simulated reflector extent diagram using a capsule of FIG. 5.

FIG. 10 is a simulation model of capsule 12 of the present embodiment as seen in a front view of the reflector extent 100, that is, as if one were standing in front of a vehicle and looking into an axially-oriented filament coil headlamp. Lamp capsule 12 is mounted inside socket hole 102. Light is reflected off reflector extent 100. The regions that form the hot spot are shown in the double-cross hatched split dumbbell shaped area 105. The hot spot images are located to the sides of the lamp spaced out from socket hole 102, and just above and below the horizontal centerline of the lamp at the ends of the horizontal extent, in a kind of dumbbell shape with a hole in the center. The area outside of the split dumbbell is the region of the reflector extent that contributes to the spread light. The area indicated by single-hatched region 108 is the portion of reflector extent 100 that is illuminated by the bluer light passing through the coated lamp capsule 12 of FIG. 5 that has windows 62. One readily observes, comparing to FIG. 3, that the spread light portion 108 that is bluish is significantly larger than the region 106, whose smaller size is indicated by dashed curved lines superimposed in region 108.

Note in FIG. 10, the boundary of the additional bluish light 108 of higher color temperature in the spread light region corresponds to the angle θ indicated in FIG. 9.

Figure 11:
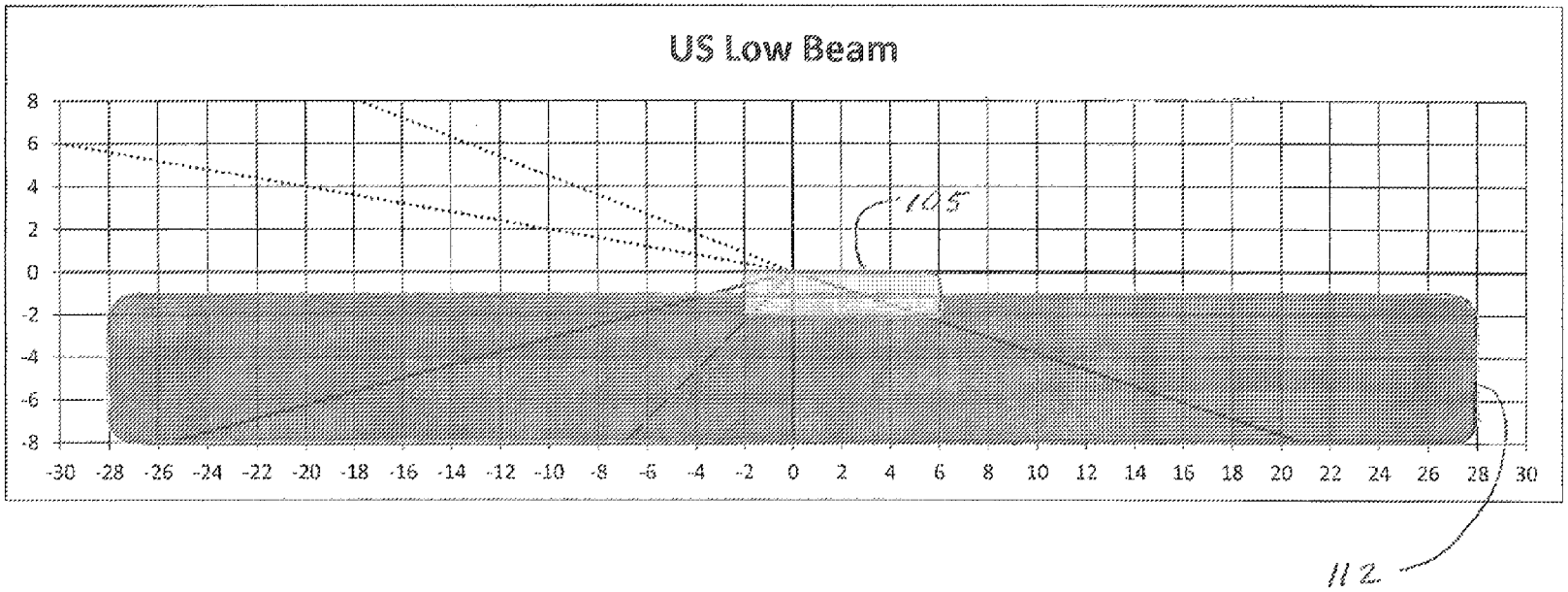
FIG. 11 is a simulated low beam pattern produced using a capsule of FIG. 5.

FIG. 11 is a simulation of the beam pattern generated onto the road by capsule 12 of the present embodiment shown in FIG. 5 showing the hot spot 105 and spread light 112. (The dark reference lines have the same meaning as used in FIG. 4). Hot spot 105 is similar to hot spot 104 of FIG. 4. Hot spot 105 has a color temperature of about 3050° K, the spread light pattern 112 has a color temperature of about 4000° K, and that there is an overlap area that has color temperature in-between those. In contrast to FIG. 4, the spread light region 112 has a color temperature that is higher since only light passing though the blue-coated capsule envelope 20 contributes to the spread light.

There is an area around socket hole 102 that cannot contribute to the hot spot. In operation, as shown in FIGS. 10 and 11, capsule 12 of the present embodiment more effectively uses the area around reflector socket hole 102 to contribute spread light that has its color temperature shifted to be more bluish. The extent angle E (FIG. 7) plays a role. The known "Night Breaker" lamp of FIGS. 1-2 has light that falls within the extent angle of the 130° envelope that one would actually prefer to be more "yellow" so as to be in the hot spot but instead that light is in the "blue" zone. The windows 62 of capsule 12 of FIGS. 5 to 8 are positioned to solve this by extending more towards capsule base 26, thus making the lower band of blue coating (below limit edge 68) on the capsule narrower in two diametrically opposed areas. The windows 62 extending more towards capsule base 26 than is the case with the known "Night Breaker" lamp of FIG. 1 makes all the hot spot to be more yellow. With the capsule of the FIG. 5 embodiment, all the light that makes the hot spot 105 comes out of the two windows 62, in theory, and different from the known "Night Breaker" lamp of FIG. 1, it is only the light the comes through the two windows 62 that contributes to hot spot 105. With the FIG. 5 capsule, light incident on the reflector around socket hole 102 contributes only to spread light.

The disclosed present embodiments result in an improved beam color temperature distribution.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, are understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

An abstract is submitted herewith. It is pointed out that this abstract is being provided to comply with the rule requiring an abstract that will allow examiners and other searchers to quickly ascertain the general subject matter of the technical disclosure. It is submitted with the understanding that it will not be used to interpret or limit the scope or meaning of the claims, as set forth in the rules of the U.S. Patent and Trademark Office.

The following non-limiting reference numerals are used in the specification:

10 vehicle headlamp
12 lamp capsule
14 reflector
16 lamp base
20 lamp envelope
22 enclosed volume
24 filament
25 capsule upper region
26 capsule base
27 filament distal portion
29 filament proximal portion
30, 32 filament supports
34, 36 external electrical leads
40 press seal

42 tubular portion
50 dome
52 opaque coating
60 light-transmissive coating
62 uncoated opening or window
64 coated portion
66 envelope
68 limit edge of window 62
70 upper ring of coating 60
80 reflecting surface
100 reflector extent
102 reflector socket hole
104 hot spot region using prior art "Night Breaker"
105 hot spot region using capsule 12
106 beam region through coating using prior art "Night Breaker"
108 beam region through coating using capsule 12
110 spread beam using prior art "Night Breaker"
112 spread beam using capsule 12
200 road right edge
202 road center line
204 road left edge
206 horizon line
208 on-coming driver's eye position in short vehicle (car)
210 on-coming driver's eye position in tall vehicle (truck)
E extent angle
O optical axis of capsule 12
P imaginary plane dividing capsule 12
X imaginary plane at angular margin of window 62
θ angle between planes X-X

What is claimed is:

1. A partially coated vehicle halogen lamp capsule (12), comprising a capsule envelope (20) having an upper region (25), a lower capsule base (26), and defining a longitudinal optical axis (O);

a filament (24) mounted within the capsule envelope (20) for emitting light when energized by electrical energy, said filament (24) mechanically supported by and electrically coupled to filament supports (30, 32) located within said capsule (12) and electrically connected to leads (34, 36) extending from said capsule base (26);

the filament (24) having a filament axial extent along said capsule optical axis (O), the filament (24) defining a filament distal portion (27) proximate the capsule upper region (25) and a filament proximal portion (29) located proximate the capsule base (26);

the capsule envelope (20) being coated with a light-transmissive coating (60) in a region extending between the capsule base (26) and a location, as seen along the optical axis (O), axially above the filament distal portion (27), with the exception of two uncoated windows (62) disposed along the capsule envelope (20);

wherein the windows (62) are devoid of the light-transmissive coating (60) and disposed in register with one another on opposite sides of an imaginary plane (P) intersecting the optical axis (O) and in which plane (P) the optical axis (O) lies;

each window (62) having an axial extent, as seen along the optical axis (O), that extends below the filament proximal portion (29) towards the capsule base (26); and each window (62) having an angular extent, in a direction around the optical axis (O) on the capsule envelope (20), such that it is bounded by respective coated portions (64) on the capsule envelope (20) that have the light-transmissive coating (60) and wherein each coated portion (64) extends angularly in a region unoccupied by the two uncoated windows (62).

2. The lamp capsule of claim 1, wherein an angular extent of the uncoated windows (62) is defined by two intersecting imaginary planes (X, X) centered on the filament (24) that intersect at a mutual angle in the range of about 87 degrees to about 100 degrees.

3. The lamp capsule of claim 1, wherein a location of an edge (68) of the window (62) below the filament proximal portion (29) is selected so that light is emitted from the capsule in a direction toward the capsule base (26) passing though the uncoated window (62) within a region bounded by a segment of a conical envelope (66) directed toward the capsule base (26) and subtended by an angle of about 82 degrees centered on the filament (24).

4. The lamp capsule of claim 1, wherein the uncoated windows (62) are disposed symmetrically on opposite sides of the imaginary plane (P).

5. The lamp capsule of claim 1, wherein a length dimension of the filament (24) is parallel the capsule optical axis (O).

6. The lamp capsule of claim 1, wherein a length dimension of the filament (24) is transverse the capsule optical axis (O).

7. The lamp capsule of claim 1, wherein, as seen in an axial direction along the optical axis (O), the capsule envelope (20) has the coating (60) between the filament distal end (27) and the capsule upper region (25).

8. The lamp capsule of claim 1, wherein the coating (60) is an absorption coating.

9. The lamp capsule of claim 1, wherein the coating (60) is a blue transmissive coating that preferentially transmits blue wavelength light.

10. The lamp capsule of claim 1, wherein the coating (60) is a blue transmissive coating that preferentially absorbs light in the red wavelength range.

11. The lamp capsule of claim 1, wherein the coating (60) is an absorption coating that absorbs yellow, red and green light more than blue and violet light.

12. The lamp capsule of claim 1, wherein the coating (60) shifts a color temperature of white light transmitted therethrough to a higher color temperature.

13. The lamp capsule of claim 1, wherein a capsule diameter is about 12 mm and the windows (62), as seen transverse the optical axis (O), have a length of about 13 mm along the optical axis (O) and a width of about 9 mm.

14. The lamp capsule of claim 1, wherein the filament (24), as viewed transverse the optical axis (O), is approximately centered with the window (62).

15. The lamp capsule of claim 14, wherein a capsule diameter is about 12 mm and the windows (62), as seen transverse the optical axis (O), have a length of about 13 mm along the optical axis (O) and a width of about 9 mm.

16. The lamp capsule of claim 1, wherein the capsule upper region (25) comprises an opaque cap (52).

17. The lamp capsule of claim 16, wherein the opaque cap has a color chosen from the group of colors consisting of gold, black, silver and blue.

* * * * *